US011591735B2

(12) United States Patent
Allen

(10) Patent No.: US 11,591,735 B2
(45) Date of Patent: Feb. 28, 2023

(54) WASHER AND DRYER COMBINATION

(71) Applicant: Terron Allen, Hazel Crest, IL (US)

(72) Inventor: Terron Allen, Hazel Crest, IL (US)

( * ) Notice: Subject to any disclaimer, the term of this patent is extended or adjusted under 35 U.S.C. 154(b) by 16 days.

(21) Appl. No.: 17/404,021

(22) Filed: Aug. 17, 2021

(65) Prior Publication Data

US 2022/0127771 A1 Apr. 28, 2022

Related U.S. Application Data

(60) Provisional application No. 63/105,533, filed on Oct. 26, 2020.

(51) Int. Cl.

| | |
|---|---|
| ***D06F 29/00*** | (2006.01) |
| ***D06F 95/00*** | (2006.01) |
| ***D06F 37/20*** | (2006.01) |
| *D06F 105/58* | (2020.01) |
| *D06F 103/04* | (2020.01) |
| *D06F 103/24* | (2020.01) |

(52) U.S. Cl.

CPC ..... *D06F 29/005* (2013.01); *D06F 37/20* (2013.01); *D06F 95/00* (2013.01); *D06F 2103/04* (2020.02); *D06F 2103/24* (2020.02); *D06F 2105/58* (2020.02)

(58) Field of Classification Search

CPC ..... D06F 29/005

See application file for complete search history.

(56) References Cited

U.S. PATENT DOCUMENTS

2007/0151303 A1* 7/2007 Doyle ..... D06F 29/005 68/3 R

2010/0077801 A1* 4/2010 Son ..... D06F 31/00 68/20

* cited by examiner

*Primary Examiner* — Jason Y Ko

(74) *Attorney, Agent, or Firm* — Brennan, Manna & Diamond, LLC

(57) ABSTRACT

The present invention relates to an improved washer and dryer combination. The washer and dryer are in a side by side configuration that has the ability to transfer washed clothes from the washer to the dryer. The washer has a movable platform that can be tilted via hydraulic arms such that any clothes within the washers can slide down a chute that connects the interior spaces of the washer and dryer to one another. When clothes are not being transferred from the washer to dryer, the chute is covered by sliding doors. In addition, the device may use a mobile application that notifies a user of the various stages of the washing, drying, and transfer process have been completed.

20 Claims, 7 Drawing Sheets

WASHER AND DRYER COMBINATION

CROSS-REFERENCE TO RELATED APPLICATION

The present application claims priority to, and the benefit of, U.S. Provisional Application No. 63/105,533, which was filed on Oct. 26, 2020 and is incorporated herein by reference in its entirety.

FIELD OF THE INVENTION

The present invention relates generally to the field of washer and dryer units. More specifically, the present invention relates to an improved washer and dryer configuration. The invention is a side-by-side washer and dryer arrangement that contains the ability to transfer washed clothes from the washer to the dryer to be dried. The device includes a movable portion of the drum or washer floor that can be tilted via hydraulic arms such that any clothes within the washers can fall into a chute that connects the interior spaces of the washer and dryer. When clothes are not being transferred from the washer to dryer, the chute is covered by sliding doors within the washer and dryer that are powered by a motor (which also may power the hydraulic arms). In addition, the washer and dryer configuration may further include a mobile application that notifies a user whether various stages of the washing, drying, and transfer process have been completed. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Washers and dryers are frequently used in residential and commercial settings to wash and dry clothes. However, many times an individual loads his or her clothes into a washer, only to forget about removing the clothes from the washer and placing them into the dryer once the wash cycle has completed. As a result, wet clothes may sit in a washer after a completed wash cycle for a prolonged period of time until an individual remembers that a wash cycle has been completed and returns to the washer to remove the clothing.

During this time, and especially if the wet clothes sit in the washer for a substantial amount of time, the clothes may become damp, moldy, and fowl smelling, such that they need to be washed again. This of course is not economical for a user, who must then pay the utility cost of running another wash cycle or if at a public laundry, the individual must pay to run another wash cycle. Further, delicate clothing may become damaged after sitting in a wrinkled condition atop other wet clothing for a long period of time after a load of laundry has been forgotten about once a wash cycle has finished. This is not desirable for a user, as delicate clothes may become ruined as a result of sitting in a pile of damp clothes for too long.

To combat the issue of forgetting to place wet clothes into the dryer after a wash cycle has completed, a user may employ the tactic of setting a reminder or alarm on their cell phone. However, this does not always work, as often times individuals become distracted from tasks away from their phone or may simply forget that the alarm has gone off. Further, alarm notifications or reminders may be buried within a borage of other notifications from the phone of a user such that the reminder goes unnoticed. In other instances, a user may not have the time to physically return to the location of the washer and transfer the clothes into a dryer.

Therefore, there exists a long-felt need in the art for an improved washer and dryer unit. There also exists in the art a long-felt need for a washer and dryer configuration that does not require a user to remember to return to the washer to transfer wet clothes to the dryer after a completed wash cycle. Further, there exists a long-felt need in the art for an improved washer and dryer arrangement that does not require that a user physically transfer wet clothes from the washer to the dryer.

The subject matter disclosed and claimed herein, in one embodiment thereof, comprises an improved washer and dryer combination. The washer and dryer combination has a plurality of internal mechanisms within the washer and dryer cabinets of the washer and dryer combination that allows wet clothes to be transferred from the washer into the dryer cabinet after a completed wash cycle without human intervention. The mechanisms include a tilting floor powered by a plurality of hydraulic arms within the washer portion of a unit, a pair of sliding doors in the adjoining sidewalls of the washer and dryer cabinets of the unit, a chute that connects the washer and dryer cabinets and a vacuum motor within the dryer unit.

In this manner, the improved washer and dryer combination of the present invention accomplishes all of the forgoing objectives and provides a washer and dryer configuration that does not require a user to remember to return to the washer to transfer wet clothes from the washer to the dryer after a completed wash cycle. Further, the improved washer and dryer arrangement does not require that any individual manually transfer wet clothes from the washer to the dryer after a completed wash cycle.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises an improved washer and dryer combination. The arrangement is configured to be a side-by-side washer and dryer, so that the two appliances share a common side wall. On both sides of the sidewall (e.g., on both the washer side and dryer side adjacent the washer side) the sidewall has a sliding door that is connected to hydraulic-powered rails. The floor of the washer further includes at least one hydraulic arm that attaches to the bottom of the floor via a pivot point. The hydraulic arm is further powered by a motor within the unit, and the unit may also power the rails of the sliding doors. Accordingly, once a wash cycle has been completed, a processer in electrical communication with the motor sends a signal to the motor, such that the hydraulic arm raises upwards and tilts the floor of the washer towards the sliding door. At this point, both sliding doors are moved upwards by the hydraulic rails which are further in electrical communication with the motor. In between each sliding door is a continuous opening in the form of a chute that slants downwards from the washer to the dryer area. Therefore, when both sliding doors open and the floor of the drum of the washer tilts toward the chute, any clothes on the floor of the washer will fall into the chute and into the interior space of the dryer. To assist in this transfer, the dryer portion may further include a vacuum motor that creates a strong vacuum force within the dryer that aids in transferring clothes from the chute to the interior space of the cabinet of the dryer.

It is further contemplated that both a portion of the drum of the washer floor and the chute have a weight sensor, and both sensors are in electrical communication with the vacuum motor and the motor located in the washer. Accordingly, if either sensor detects weight (e.g., the weight of clothes) the vacuum motor and the raising or tilting of the floor or drum by the washer motor will not cease until no weight is detected or an assigned weight reading is received. Therefore, this process ensures that the dryer cycle cannot be started with clothes still stuck in the washer area or chute.

In addition, the washer dryer combination may have an accompanying mobile application, which is software downloaded on to the device. The application can be used on any smart device and includes a notification system. The system notifies the user of a plurality of events related to the unit such as whether a wash cycle has or has not been successfully completed, if the transfer of clothes from the washer the dryer has or has not been successfully completed, and/or that a drying cycle has or has not been successfully completed. As a result, in the event of a malfunction of the clothes-transferring process from the washer to dryer portions of the unit, a user may be appropriately notified and intervene to correct the problem so that the dryer and or washer can commence the next cycle. Therefore, the notification system prevents a user from relying on the transfer to have been successful when it has not actually been successful. This in turn prevents dried clothes from becoming wrinkled after sitting in the dryer as a result of the user forgetting to remove the dried clothes, as well as prevents wet clothes from sitting in the washer or chute and not having been successfully transferred to the dryer. It is also further contemplated that all controls of the appliances may be accessed via the mobile application so that a user can remotely control the start or stop of washing and drying cycles, among other features.

Therefore, the improved washer and dryer configuration of the present invention is particularly advantageous as it provides a plurality of features not known to be found in existing washer and dryer appliances, such as the ability to be notified when a washing or drying cycle has been completed. Further, the unit does not require an individual to physically transfer washed clothes to the dryer. In addition, the unit does not even require a user to be present to operate any process of the unit, which is extremely convenient and desirable.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
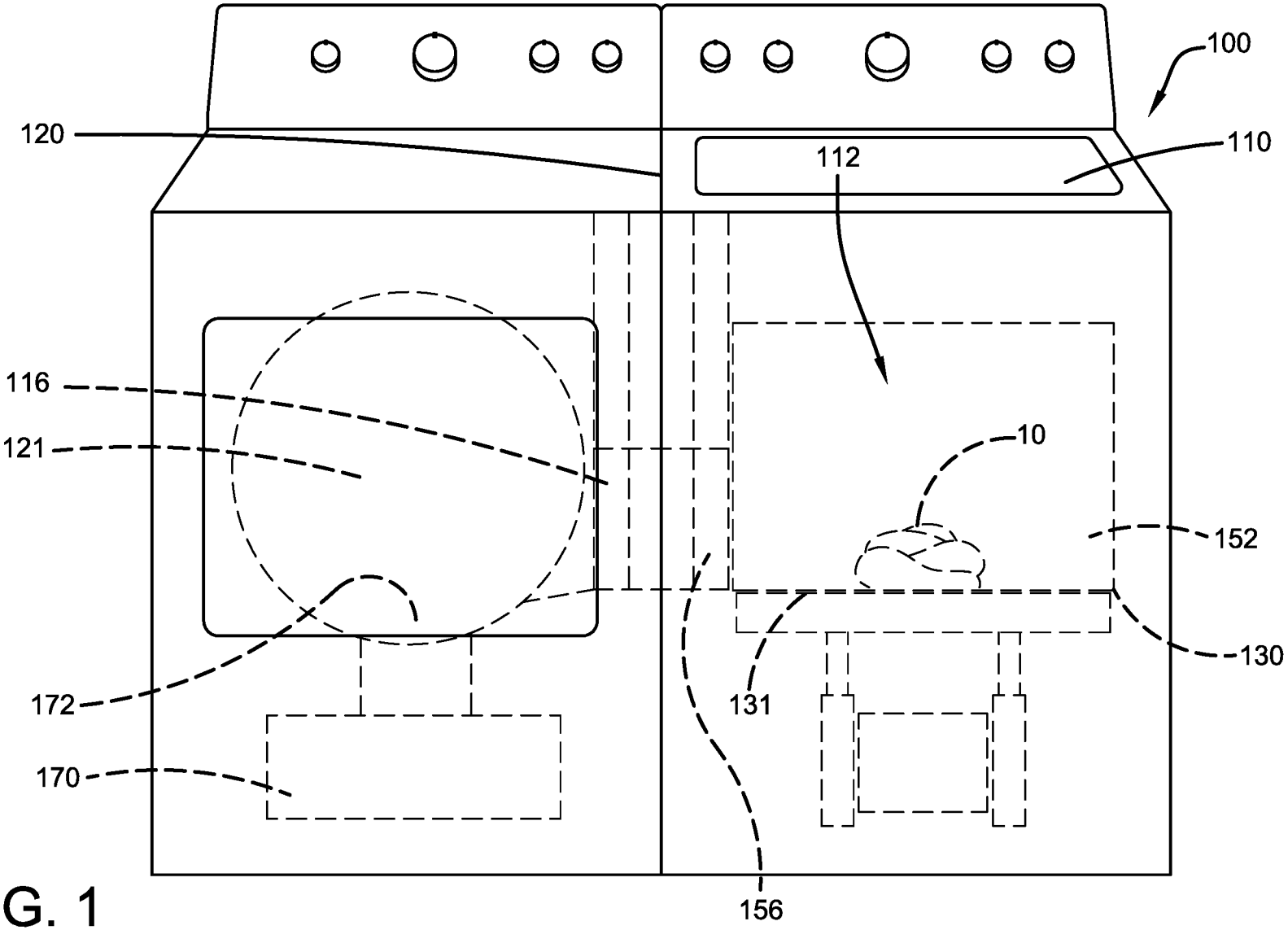
FIG. 1 illustrates a perspective view of one potential embodiment of an improved washer and dryer combination of the present invention in accordance with the disclosed architecture, wherein the floor of the drum is in a relatively flat position and the sliding doors are in a closed position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved washer and dryer combination. There also exists in the art a long-felt need for a washer and dryer arrangement that does not require a user to remember to return to the washer to manually transfer wet clothes to the dryer after a completed wash cycle. In addition, there exists a long-felt need in the art for an improved washer and dryer combination that does not require that a user to physically transfer wet clothes from the washer to the dryer.

The present invention, in one exemplary embodiment, is comprised of an improved washer and dryer configuration that is arranged in a side-by-side washer and dryer configuration, in which the two appliances share a common side wall. Both sides of the sidewall (e.g., both the washer side and dryer side adjacent the washer) have a sliding door that is connected to hydraulic-powered rails. Similarly, the floor of the drum of the washer has at least one hydraulic arm that attaches to the bottom of the wall via a pivot point. The hydraulic arm is powered by a motor within the unit. Further, the motor may also power the rails of the sliding doors.

Moreover, once a wash cycle has been completed a processer in electrical communication with the motor sends a signal to the motor such that the at least one hydraulic arm raises upwards and tilts a portion of the floor of the drum or cabinet of the washer towards the sliding door. At this point, both sliding doors of the washer and dryer interior spaces are raised upwards by the hydraulic rails, forming an opening. The rails are also in electrical communication with the motor. In between each sliding door, a continuous opening in the form of a chute is present, and the chute slants downwards from the washer towards the dryer area to allow the clothes to travel from the washer to the dryer. Therefore, when both sliding doors open and the portion of the floor of the drum or cabinet of the washer tilts toward the chute, any clothes on the floor or in the cabinet of the washer will fall onto the chute and then into the dryer. To assist in this transfer, the dryer portion may have a vacuum motor that creates a strong vacuum force within the cabinet of the dryer that aids in transferring clothes from the chute to the interior space of the dryer by creating a suction force to pull or draw the clothes into the dryer portion.

In addition, both the floor of the drum or cabinets of the washer and the chute have a weight sensor, and both sensors are in electrical communication with the vacuum motor and motor located in the washer. Accordingly, if either sensor detects weight (e.g., the weight of clothes or some other predetermined value) the vacuum motor and the raising of the portion of the drum floor by the washer motor will not cease until no weight or the predetermined value is detected. Therefore, this process ensures that the dryer cycle cannot be started with clothes still resting on the washer drum floor or chute. If the sensors do not clear the weight or arrive at the predetermined value after a predetermined amount of time, the washer will stop, and an alarm signal will be generated.

The appliance may also have an accompanying software application. The application can be used on any smart device and includes a notification system. The system notifies the user of a plurality of events related to the appliances, such as whether a wash cycle has or has not been successfully completed, if the transfer of clothes from the washer the dryer has or has not been successfully completed and/or that a drying cycle has or has not been successfully completed. As a result, in the event of a malfunction of the appliance during the clothes transferring process from the washer to dryer, a user may be appropriately notified and intervene to correct the problem. In the interim, the appliances are shut down until human intervention arrives and renders assistance. Therefore, the notification system prevents a user from relying on the transfer to have been successful when it has not actually been successful. This in turn prevents dried clothes from becoming wrinkled after sitting in the dryer as a result of the user forgetting to remove the dried clothes, as well as preventing wet clothes from sitting in the washer or chute in the event that they were not successfully transferred to the dryer. It is also further contemplated that all controls of the unit may be accessed via the software application such that a user can remotely control the start or stop of washing and drying cycles, in addition to other features.

Referring initially to the drawings, FIG. 1 illustrates a perspective view of one potential embodiment of an improved washer and dryer appliance 100 of the present invention showing the floor 130 of the drum in a flat position and the sliding doors 116, 156 in a closed position. The combination appliance 100 includes a washer 110 portion and dryer 150 portion that are arranged in a side-by-side fashion and share a common sidewall 120 (e.g. the sidewall 120 makes up one side wall of the washer 110 and also one sidewall 120 of the dryer 150). It is further contemplated that although the features are not the focus of the claimed invention, the washer 110 and dryer 150 have the traditional features of all existing washer and drying appliances. These features may include, but are not limited to: a plurality of timed drying/washing cycle settings, a plurality of washing/drying intensities and settings, a plurality of dials or display screens which may allow a user to select washing/drying cycles, intensities, and settings, etc. Accordingly, the washer 110 and dryer 150 contain enough features of washers and dryers such that the washer 110 and dryer 150 of the combination 100 function properly to wash and dry clothes. The washer 110 and dryer 150 also both have interior spaces or cabinets 112, 152 that can receive clothes 10 for washing and drying. It is contemplated that each side of the shared sidewall 120 further includes a plurality of hydraulic-powered rails 118, 158 and a sliding door 116, 156 which allows clothes 10 to be transferred from the washer 110 cabinet of the unit 100 to the dryer 150 portion.

Figure 2:
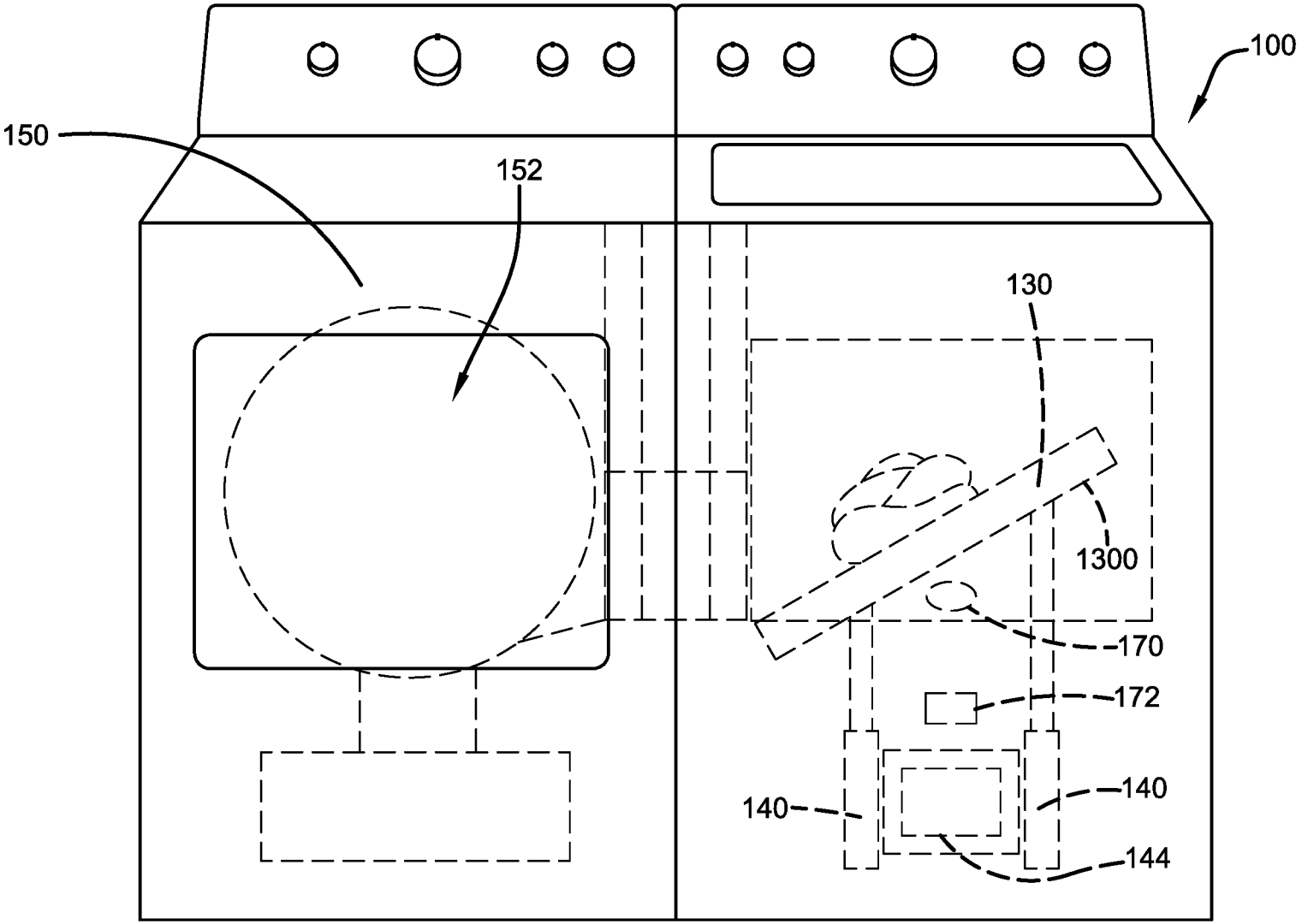
FIG. 2 illustrates a perspective view of one potential embodiment of the improved washer and dryer combination of the present invention in accordance with the disclosed architecture, wherein the floor of the drum is in a tilted position and the sliding doors are in a closed position.

FIG. 2 illustrates a perspective view of one potential embodiment of the improved washer and dryer combination 100 of the present invention showing the floor 130 in a tilted position and the sliding doors 116, 156 in a closed position. The washer 110 also has a drum floor 130 which is enclosed by a waterproof rubber gasket 1300 to prevent water from leaking underneath the floor 130 during a wash cycle, since the drum floor 130 is movable and therefore any components underneath the floor 130 are not sealed from water from the interior space 112 of the washer 110. The portion of the drum floor 130 further attaches to at least one hydraulic arm 140 (but preferably more than one arm 140). At least one hydraulic arm 140 also includes a housing 142 that attaches to and is powered by a motor 144. It is contemplated that the motor 144 may be located in any portion of the washer 100, but is preferably located under the portion of the floor 130 within the washer 110. As such, the at least one hydraulic arm 140 is further mechanically and/or electrically connected to the motor 144, such that the motor 144 powers the at least one arm 140 and allows it to raise and lower. In differing embodiments, the motor 144 may be a small electrical motor that may receive power from the unit 100 itself. The drum cabinet 152 of the washer also has a position sensor 171, so that the portion of drum floor 130 is in the correct position before the tilting commences. If the drum is not in the proper position, the sensor 171 which is connected to a controller 172, will cause the drum cabinet 152 to rotate forward or backwards so that the portion of the drum having the movable floor 130 is in the proper position to allow for the transfer of the laundry into the dryer cabinet.

The motor 144 includes a processor 146, which is in electrical communication with the motor 144 and controls when the motor 144 raises and lowers the at least one hydraulic arm 140, and to what height the at least one hydraulic arm 140 is raised or lowered. As noted, in the preferred embodiment the appliance 100 has two hydraulic arms 140 that are connected to the bottom surface of a portion of the floor of the drum 130 via hinge points 132 on the bottom surface 131 of the floor of the drum 130. The processor 146 is in electrical communication with the appliance 100 such that when a washing cycle has been completed, the processor 146 automatically enables the motor 144 to lower one hydraulic arm 140 (or keep the arm 140 at its current height) and raise the other arm 140 such that the portion of the floor of the drum 130 pivots on each hinge point 132 and begins to tilt or slant downwards towards the sliding door 116 of the washer 110.

Figure 3A:
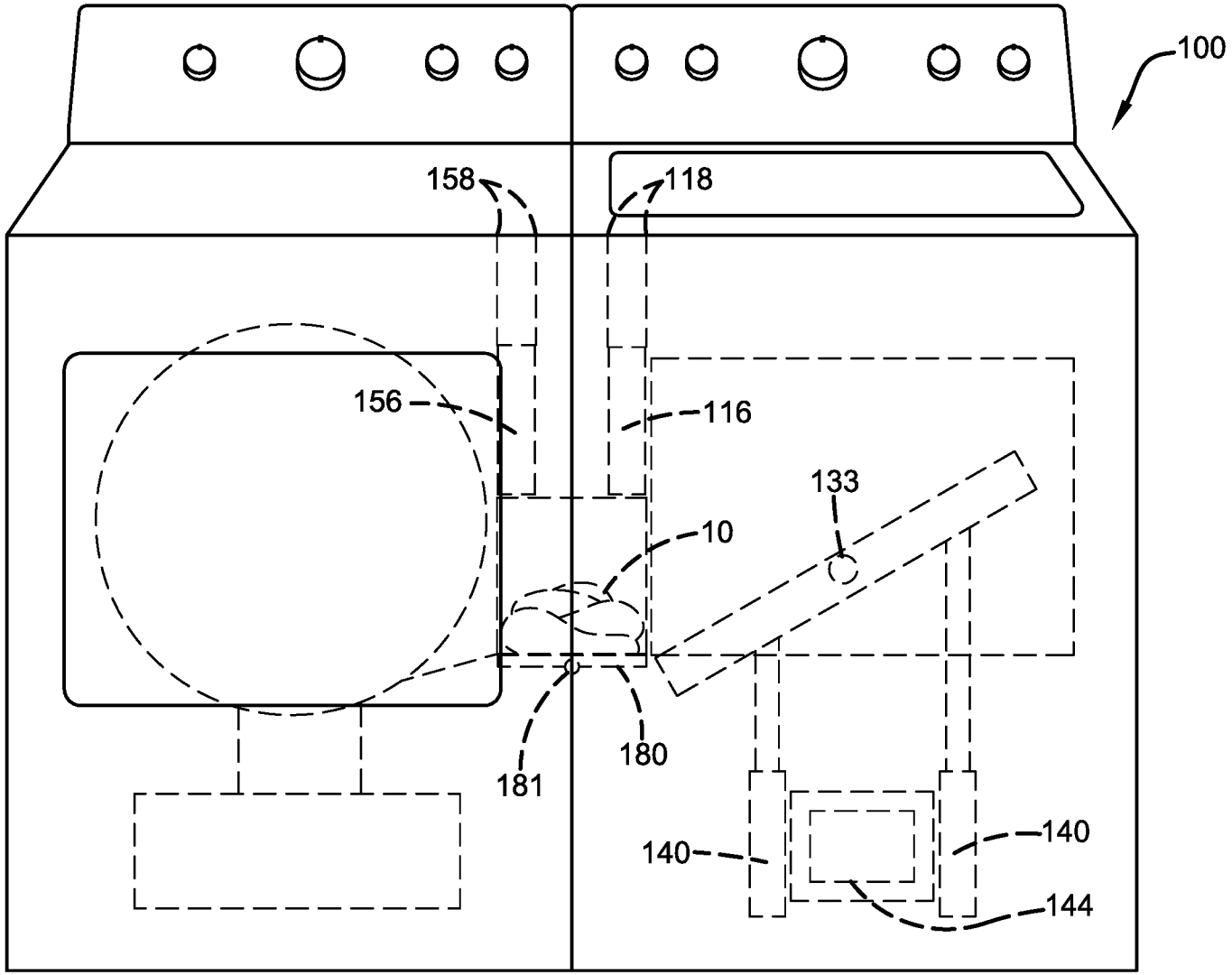
FIG. 3A illustrates a perspective view of one potential embodiment of the improved washer and dryer combination of the present invention in accordance with the disclosed architecture, wherein the floor of the drum is in a tilted position and the sliding doors are in an open position.
Figure 3B:
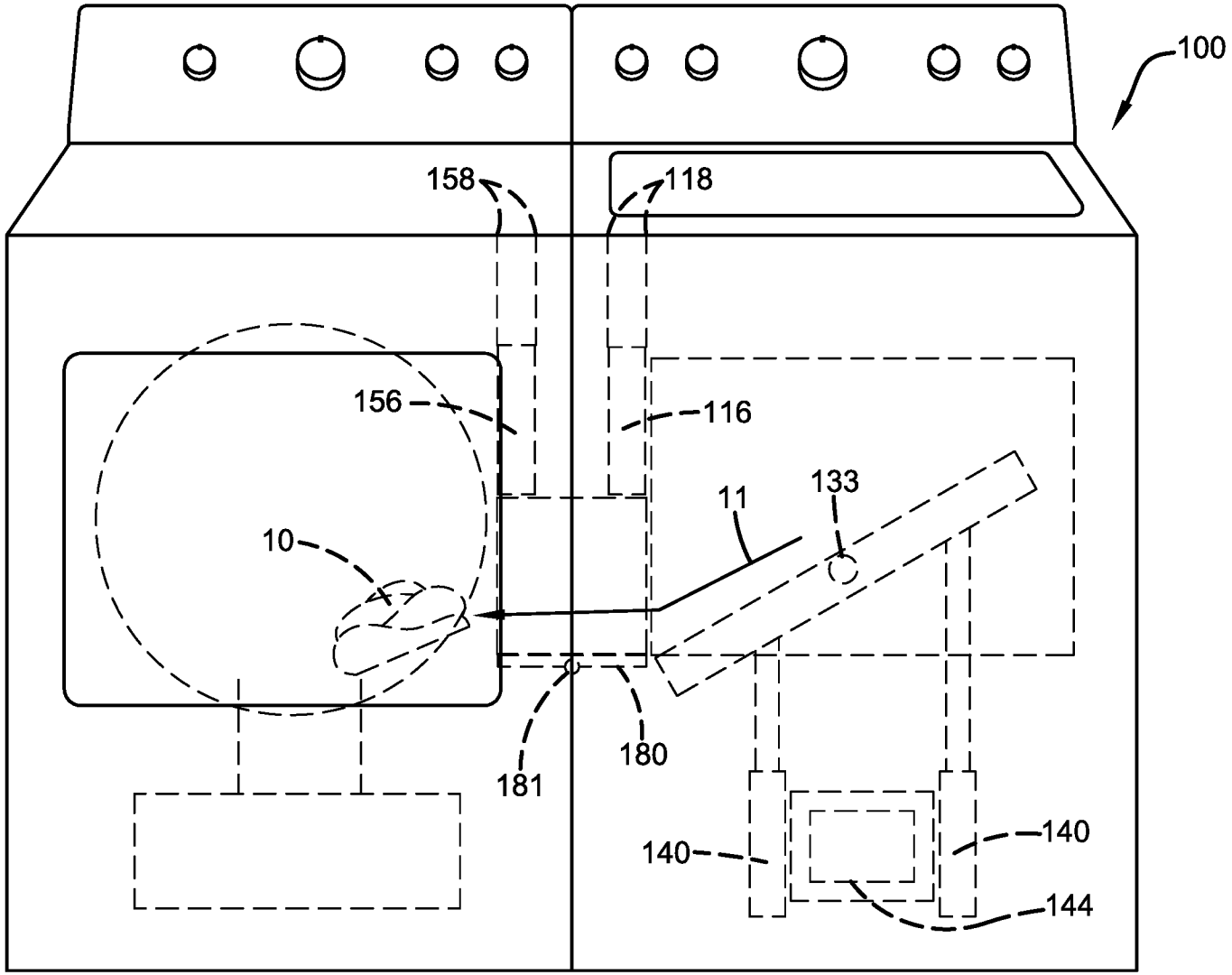
FIG. 3B illustrates a schematic view of a load of washed clothes being transferred from one potential embodiment of the washer to one potential embodiment of the dryer of the present invention in accordance with the disclosed architecture, wherein the direction of travel is clearly illustrated.
Figure 4A:
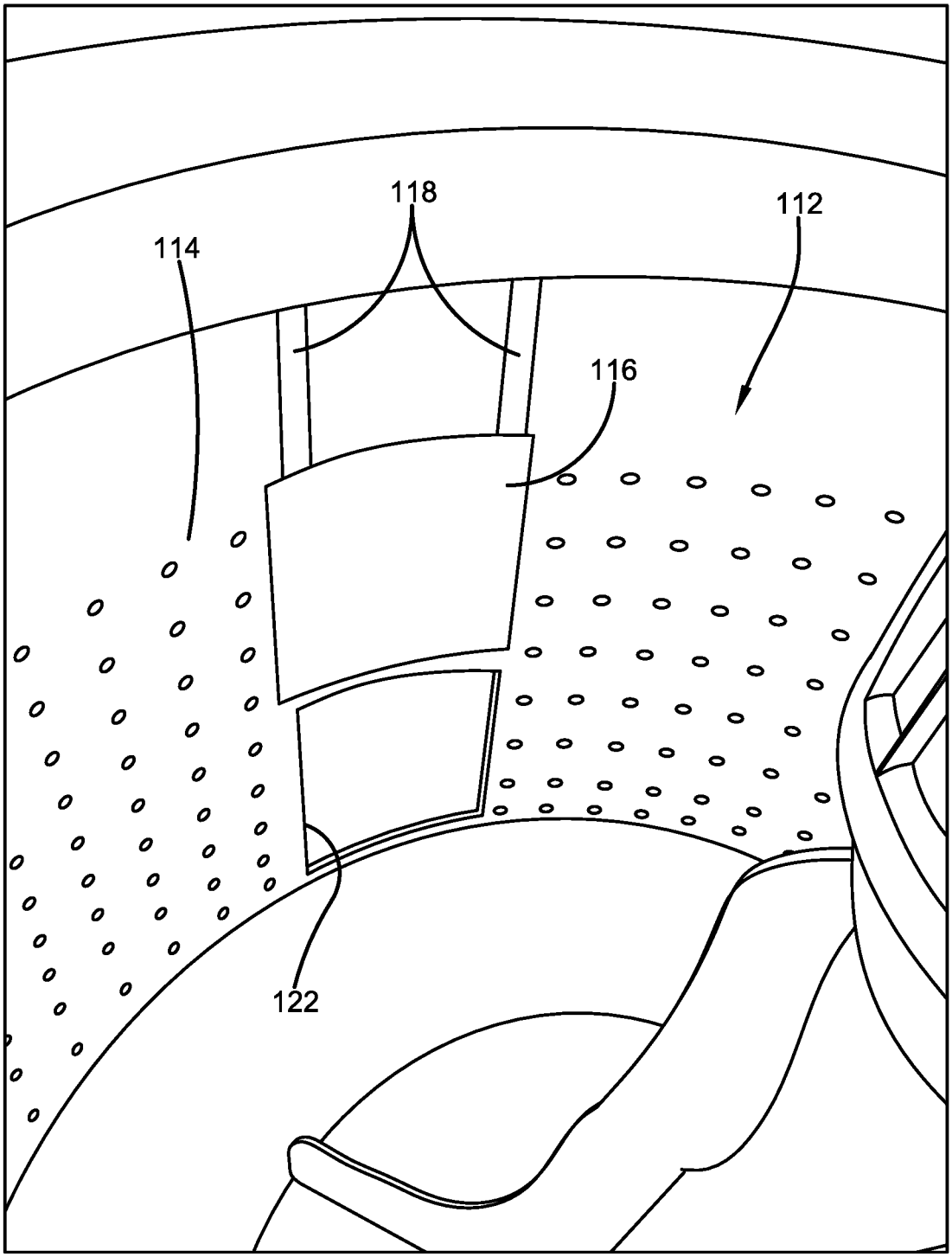
FIG. 4A illustrates a perspective view of the interior space of one potential embodiment of the washer portion of the improved washer and dryer combination of the present invention in accordance with the disclosed architecture, wherein the sliding door is in an opened position.
Figure 4B:
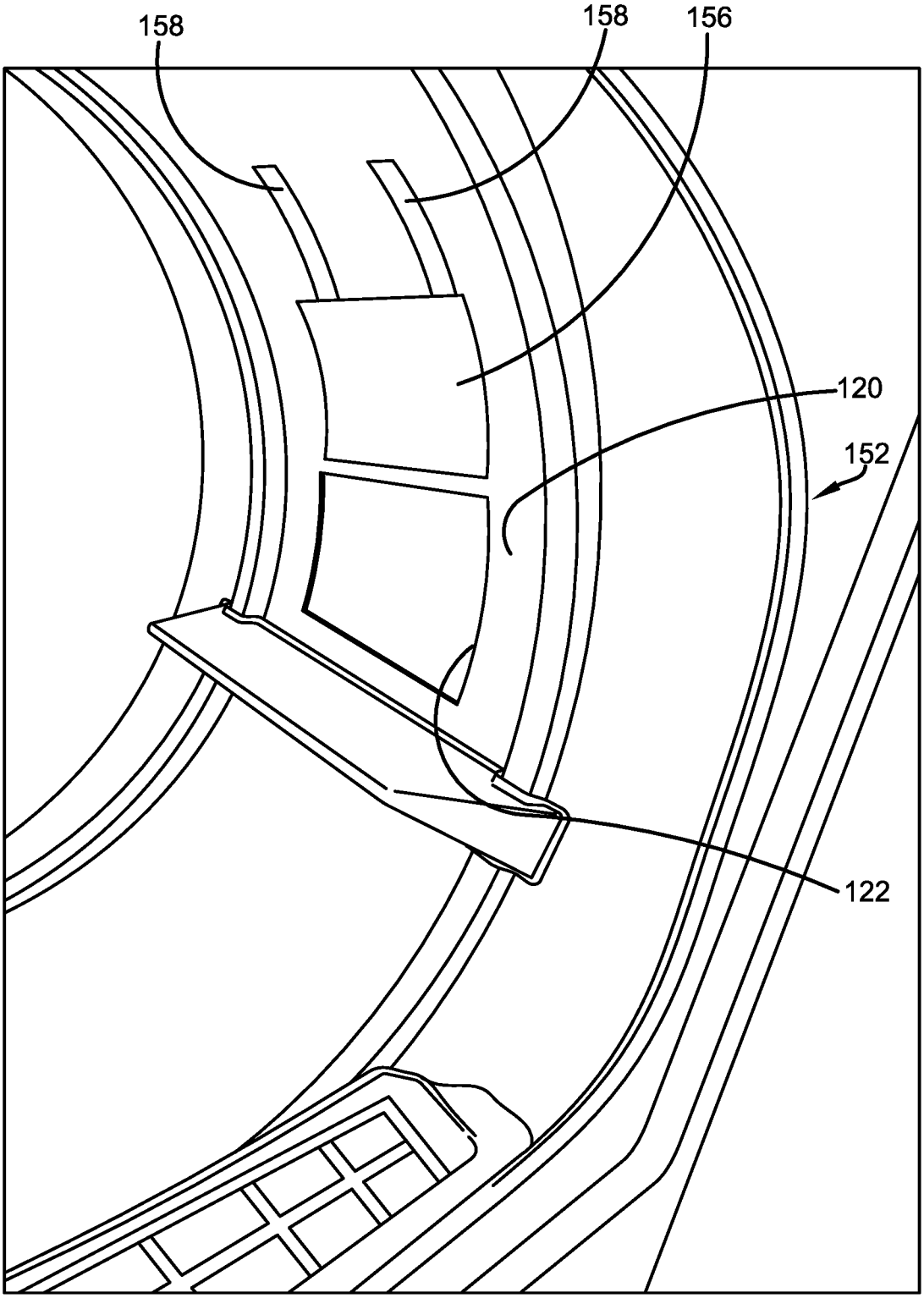
FIG. 4B illustrates a perspective view of the interior space of one potential embodiment of the dryer portion of the improved washer and dryer combination of the present invention in accordance with the disclosed architecture, wherein the sliding door is in an opened position.

Simultaneously, the motor 144 may be in electrical communication with and automatically power the hydraulic rails 118, 158 of both the washer 110 and dryer 150 portions of the unit 100, such that both sliding doors 116, 156 that are fixedly connected to the rails 118, 158 travel upwards (e.g. are raised), thereby exposing a continuous opening 122 in the sidewall 120, as seen in FIG. 3A. The motor and processor may also be connected to a controller as shown in FIG. 2. FIG. 3B illustrates a schematic of the washer and dryer combination 100 of the present invention in which the washed items 10 move from the washer 110 to the dryer 150 by the elevated chute 180, as shown by the direction of travel 11. It is contemplated that in differing embodiments of the appliance 100, each door 116, 118 may be attached to at least one, but preferably two sets of hydraulic rails 118, 158 as shown in FIGS. 4A, and 4B. Further, the continuous opening 122 of the sidewall 120 may also be in the form of a chute 180. It is contemplated that the chute 180 is angled downward such that it slopes from the washer 110 to the dryer 150 to facilitate the transfer of clothes 10 that are entering the chute 180 as a result of the floor 130 tilting. The angle of tilt may also be based on the weight of the clothing in the washer. More significant loads require a higher tilt, and a lower weight load may require a lower tilt as the vacuum of the dryer may more readily assist in drawing the clothing in to the dryer.

The transfer of clothes 10 from the washer 110 to the dryer 150 may also be aided by a vacuum motor 170 that is located within some portion of the dryer 150 and connects to the interior space 152 of the dryer 150 via a continuous opening 172. Accordingly, the vacuum motor 170 is preferably in electrical communication with the motor 144 of the washer 110, such that when the washer 110 motor 144 begins to raise or lower the hydraulic arms 140 and open both doors 116, 156 the vacuum motor 170 is automatically activated. The activation of the vacuum motor 170 then creates a vacuum force that pulls or draws the clothes 100 from the washer 110, through the chute 180 and into the dryer 150. It should also be noted that the chute 180 and floor 130 may have weight sensors 133, 181. Each weight sensor 133, 181 is in electrical communication with both motors 144, 170, as well as the processor, such that the washer 110 motor 144 does not stop raising one hydraulic arm 140 until no weight or a predetermined weight (e.g., the weight of clothes 10 still resting on the floor 130) is detected by the weight sensor 133 on the floor of the drum 130, and the vacuum motor 170 does not cease creating a vacuum force until the weight sensor 181 of the chute 180 detects no weight (e.g. the weight of clothes 10 still stuck in the chute 180) within the chute 180. In this manner, it is ensured that no clothes 10 will remain trapped on the floor 130 or within the chute 180 after a wash cycle (having not been successfully transferred to the dryer 150). After both weight sensors 133, 181 detect no weight, both sliding doors 116, 156 may then automatically close. At this point, the dryer unit 150 can then begin the normal drying process to dry the clothes 10 that have been transferred.

Figure 5:
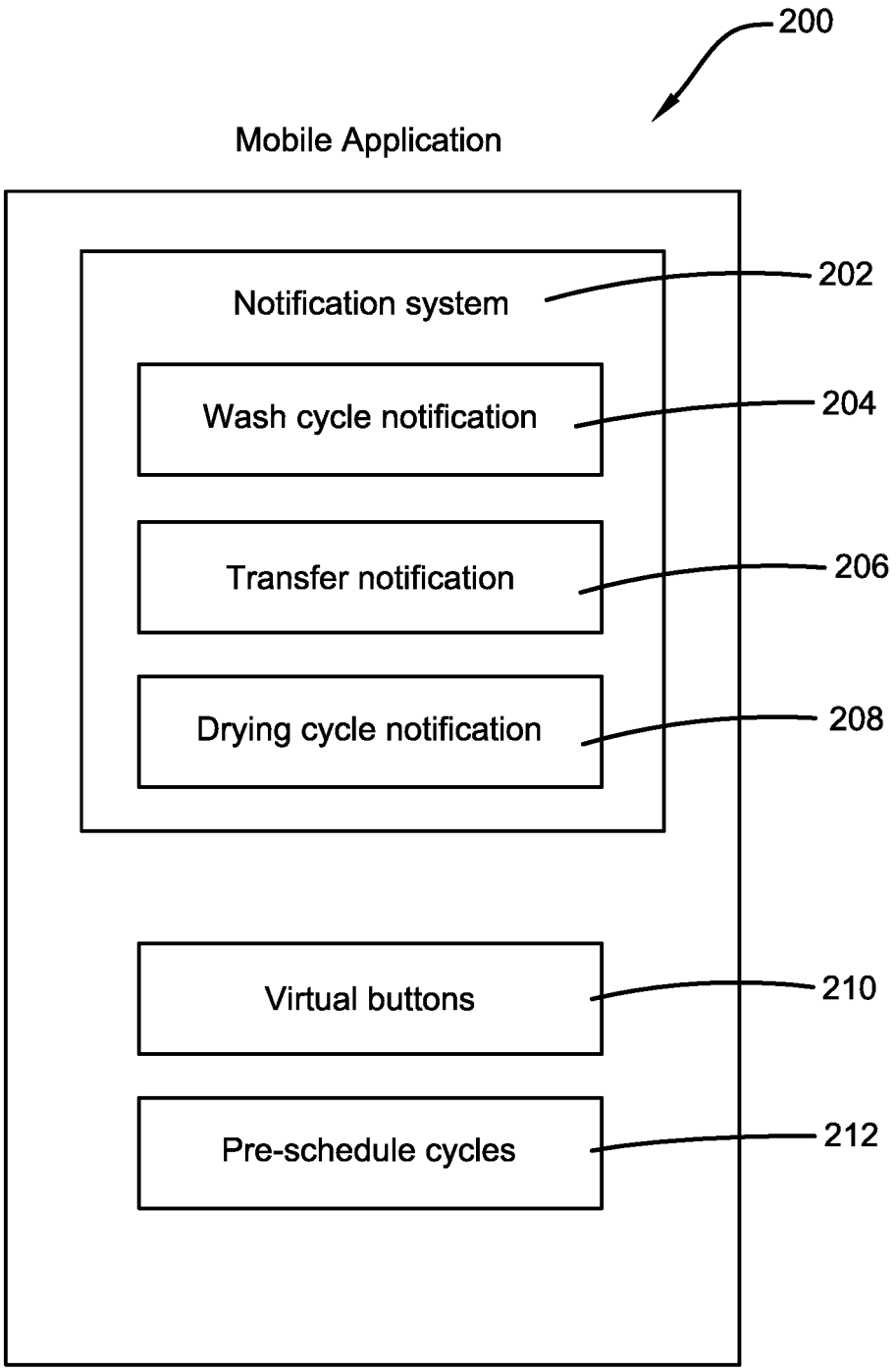
FIG. 5 illustrates a graphical view of a mobile application of one potential embodiment of the improved washer and dryer combination of the present invention in accordance with the disclosed architecture, wherein the mobile application may be used to control the washer and dryer combination.

FIG. 5 illustrates a graphical view of a mobile application 200 of an embodiment of an improved washer and dryer appliance configuration 100 of the present invention. The appliance 100 may also have an accompanying mobile application 200 that has a plurality of features and can be used on any smart device (e.g., smartphone, tablet, laptop, computer, etc.). One such feature includes a notification system 202, which may notify the user of a plurality of events related to the appliance 100. The events can include notifying the user that a wash cycle has or has not been successfully completed 204, the transfer of clothes 10 from the washer 110 the dryer 150 has or has not been successfully completed 206 and that a drying cycle has or has not been successfully completed 208. Therefore, in the event of a malfunction of the clothes transferring process from the washer 110 to dryer 150, such as the clothes have not been fully transferred, a user may intervene and correct the problem. As a result, this feature of the notification system 202 prevents a user from relying on the transfer to have been successful when it has not. Further, the notification system 202 prevents dried clothes 10 from becoming wrinkled after sitting in the dryer 150 as a result of the user forgetting to remove the dried clothes 10, and also prevents wet clothes 10 from sitting in the washer 110 or chute 180 if they were not successfully transferred to the dryer 150.

In addition, the mobile application 200 may allow the user to control all features of the appliance 100 via the application by way of virtual buttons 210 that mimic the appearance of any physical buttons that the appliance configuration 100 may have. Accordingly, the virtual buttons 210 may allow a user to remotely control features of the appliance 100 such as but not limited to: The starting of a wash cycle, the starting of a drying cycle, the type (e.g., speed, temperature, intensity, etc.) of wash or drying cycle, the power of the appliance 100, etc. Further, the application 200 may allow a user to pre-schedule washing or drying cycles 212 such that a washing or drying cycle will begin at a certain date and time. This allows a user to control factors like when a drying cycle ends, which is especially crucial in the case where a user may not be home (but will be soon) and certain clothes 10 within the dryer 150 must be hung immediately after drying. The user may schedule operation of the applicant to obtain "time of day" rates to take advantages of lower utility rates. Therefore, the application 200 allows a user to ensure that they can commence the drying cycle in such a way that the cycle finishes as soon as they arrive home, thereby mitigating the possibility of any clothes 10 becoming wrinkled due to the fact that they were not hung up soon enough after being dried.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "improved washer and dryer unit", "improved washer and dryer unit device", "washer and dryer unit", "unit", and "device", are interchangeable and refer to the improved washer and dryer unit 100 of the present invention.

Notwithstanding the forgoing, improved washer and dryer unit 100 of the present invention and its various components can be of any suitable size and configuration as is known in the art without affecting the overall concept of the invention, provided that they accomplish the above-stated objectives. One of ordinary skill in the art will appreciate that the size, configuration and material of the improved washer and dryer unit 100 as shown in the FIGS. are for illustrative purposes only, and that many other sizes and shapes of the improved washer and dryer unit 100 are well within the scope of the present disclosure. Although the dimensions of the improved washer and dryer unit 100 are important design parameters for user convenience, the improved washer and dryer unit 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A combination appliance comprising:

a washer having a drum and a washer sidewall;

a dryer having a cabinet and a dryer sidewall;

the washer and the dryer having a shared sidewall securing the washer and the dryer together to form the combined appliance; and the shared sidewall having an opening allowing for a transfer of a washed item from the washer to the dryer.

2. The combination appliance as recited in claim 1, wherein the opening has a door for each of the washer and the dryer.

3. The combination appliance as recited in claim 1, wherein the drum of the washer has a movable portion for dislodging the washed item from the drum of the washer.

4. The combination appliance as recited in claim 3, wherein the movable portion tilts upwardly through use of at least one hydraulic lift to move the washed item from the washer to the dryer through the opening.

5. The combination appliance as recited in claim 1, wherein the dryer has a vacuum for creating a force to draw or pull the washed item through the opening.

6. The combination appliance as recited in claim 1, wherein the washer has a position sensor to determine a position of the drum.

7. The combination appliance as recited in claim 1, wherein the washer has a weight sensor to determine a weight of the washed item in the washer.

8. The combination appliance as recited in claim 1, wherein the washer includes a processor for controlling the opening and a position sensor for controlling a position of the drum such that the opening between the washer and the dryer is aligned.

9. The combination appliance as recited in claim 1, wherein each of washer and the dryer are controllable via a software application downloaded on to a smart device.

10. The combination appliance as recited in claim 9, wherein the software application includes a notification to alert a user to a status of the washer or the dryer.

11. A washer and dryer combination comprising:

a washer having a cabinet containing a drum, the drum having a portion to create an elevatable platform;

a dryer having a dryer cabinet and a vacuum to create a force to draw or pull washed items from the washer into the dryer cabinet;

the washer and the dryer each having an adjacent sidewall with an opening therein to allow for a transfer of a washed item from the washer to the dryer; and the elevatable platform raises to form a tilted platform to allow the washed item to slide into the dryer cabinet from the washer.

12. The washer and dryer combination as recited in claim 11, wherein the washer further comprises a weight sensor connected to the elevatable platform.

13. The washer and dryer combination as recited in claim 11, wherein the washer further comprises a position sensor to align the drum with the opening in the adjacent sidewall.

14. The washer and dryer combination as recited in claim 12, wherein elevatable platform is connected to at least one hydraulic arm to elevate the elevatable platform to a tilted position to allow the washed item to slide from the washer to the dryer through the opening.

15. The washer and dryer combination as recited in claim 14, wherein the vacuum pulls the washed item into the dryer when the elevated platform is in the tilted position.

16. The washer and dryer combination as recited in claim 11, wherein each of the washer and the dryer has a door in the adjacent sidewall.

17. The washer and dryer combination as recited in claim 16, wherein the door is connected to a hydraulic arm to raise and lower each of the doors.

18. The washer and dryer combination as recited in claim 11, wherein a processor is connected to the opening and elevatable platform.

19. A washer and dryer combination comprising:

a dryer having a cabinet, a vacuum and a sidewall that is adjacent to a washer;

the washer having a washer sidewall that is adjacent to the dryer and a drum, wherein a portion of the drum forms an elevatable platform;

the washer sidewall has a first opening therein covered by a first movable door, and the adjacent sidewall in the dryer has a second opening covered by a second movable door; and the second opening of the dryer is in communication with the first opening in the washer to allow a washed item to transfer from the washer to the dryer; and the elevatable platform raises to a tilting position such that the washed item moves to the dryer through the first opening in the washer and the second opening in the dryer and the vacuum creates a force to draw the washed item into the dryer.

20. The washer and dryer combination as recited in claim 19, wherein the washer includes a weight sensor to detect whether the washed item has moved from the washer to the dryer.

* * * * *